United States Patent [19]

Gregory

[11] 4,155,310

[45] May 22, 1979

[54] ERASER CRUMB CATCHER

[76] Inventor: Robert R. Gregory, 1481 Sylvaner Ave., St. Helena, Calif. 94574

[21] Appl. No.: 885,910

[22] Filed: Mar. 13, 1978

[51] Int. Cl.[2] ..... A47B 85/00; A47D 15/00

[52] U.S. Cl. ..... 108/26

[58] Field of Search ..... 108/26, 69, 27; 297/182; 312/231

[56] References Cited

U.S. PATENT DOCUMENTS

| | | | |
|---|---|---|---|
| 2,263,863 | 11/1941 | Wolfe | 297/182 X |
| 2,526,576 | 10/1950 | Nelson | 297/182 |
| 2,540,685 | 2/1951 | Mayer | 297/182 |
| 2,645,230 | 7/1953 | Knapp | 108/26 X |
| 2,707,141 | 4/1955 | Witter | 108/26 |
| 3,080,141 | 3/1963 | Ricci | 108/26 X |
| 3,244,465 | 4/1966 | Ulrich, Jr. et al. | 312/231 |

*Primary Examiner*—Roy D. Frazier
*Assistant Examiner*—Peter A. Aschenbrenner
*Attorney, Agent, or Firm*—Melvin R. Stidham

[57] ABSTRACT

An eraser crumb catcher comprising an elongated trough which is removably supported on a bracket secured along an edge of a drafting table. The trough has an inboard side which extends down from the edge of the table and an outboard side which curves up and out and then back to terminate above the edge forming a cowl or deflecter to deflect the eraser crumbs brushed from the table to the trough.

5 Claims, 4 Drawing Figures

ERASER CRUMB CATCHER

BACKGROUND OF THE INVENTION

Draftsmen, designers, engineers and the like notoriously generate a considerable amount of eraser crumbs during the course of a session at the drafting table. Generally, draftsmen keep a brush handy to sweep such crumbs from the paper and being preoccupied with their work, often do so without particular concern for waste baskets or the like. As a result, the floor around the drafting table, and often even the clothing of persons nearby become messy with the eraser crumbs.

OBJECTS OF THE INVENTION

It is an object of this invention to provide a convenient device for collecting eraser crumbs brushed from a drafting table.

It is a further object of this invention to provide a device for collecting eraser crumbs which does not require the draftsman to divert his attention from the drafting board.

Other objects and advantages of this invention will become apparent from the description to follow, particularly when read in conjunction with the accompanying drawing.

BRIEF SUMMARY OF THE INVENTION

In carrying out this invention I provide an elongated trough having a vertical front wall from the lower edge of which the back wall and deflector curves up and first out and then back, in generally semi-cylindrical configuration to terminate above the level of the upper edge of the front wall. A bracket is secured along the edge of the drafting table, preferably the top edge across from the draftman's normal position, and interengaging means are provided on the bracket and trough with which to suspend the trough from the drafting board edge. A horizontal ledge on either the bracket or the upper edge of the trough front wall forms a continuation of the table's upper surface when the trough is in place. Removable caps may be secured to the ends of the trough to form a container. With the back wall curving back and above the edge of drafting table, eraser crumbs may simply be swept off the table edge to be deflected into the trough.

DESCRIPTION OF PREFERRED EMBODIMENT

Figure 3:
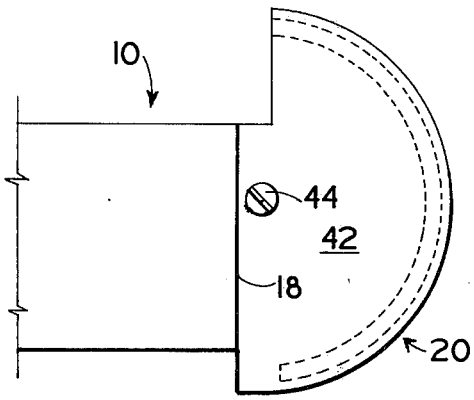
FIG. 3 is an end view of the eraser crumb catcher.
Figure 2:
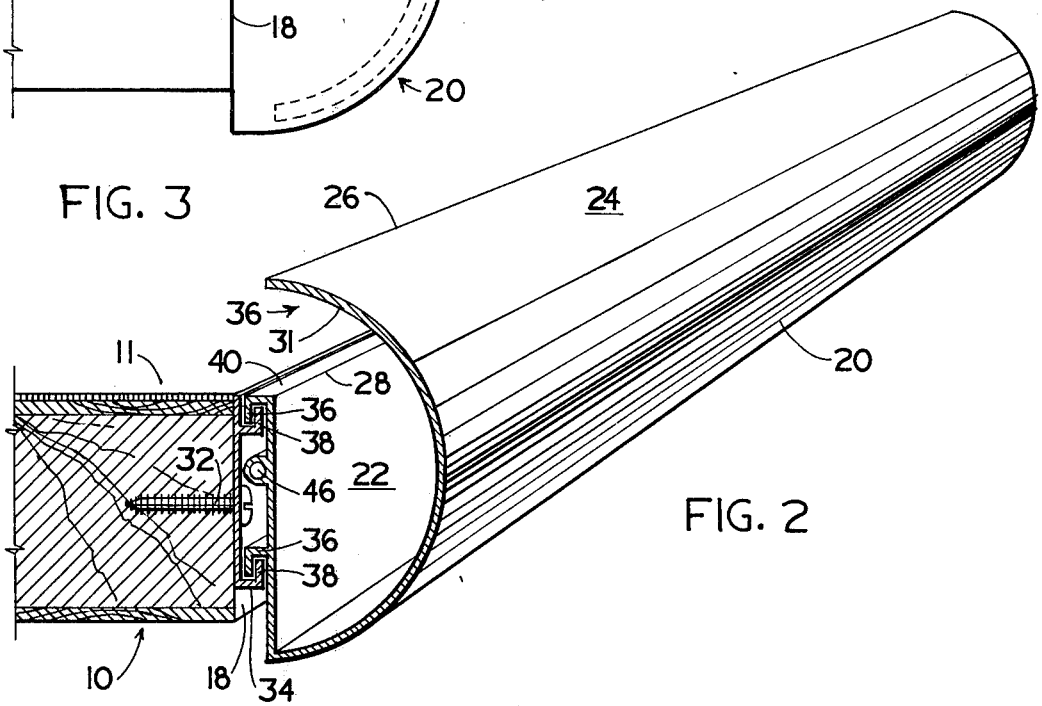
FIG. 2 is a view in perspective taken through a section of a drafting table and eraser crumb catcher.
Figure 1:
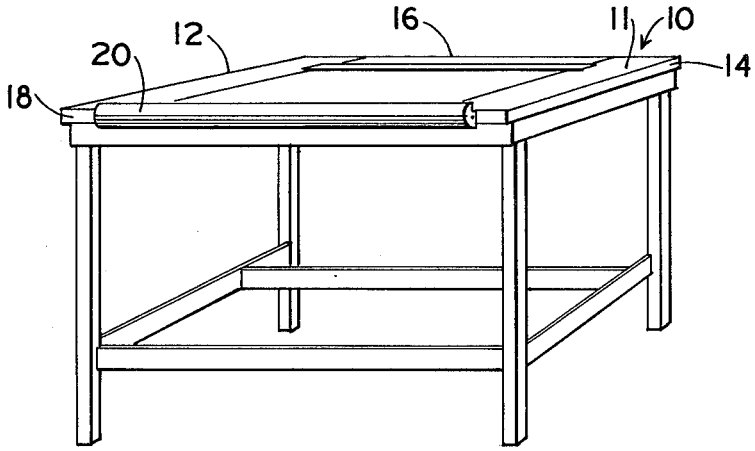
FIG. 1 is a view in perspective of a drafting table with the crumb catcher of this invention installed thereon.

The Embodiments of FIGS. 1 to 3

Referring now to the drawings with greater particularity there is shown a conventional drafting table 10 having a top working surface 11, side edges 12 and 14, the front edge 16 behind which the draftsman customarily sits or stands and the top edge 18. The eraser crumb catcher 20 of this invention is secured to one of the table edges, and preferably to the top edge 18 to present minimum interference with movements of the draftsman, his paper and tools.

As shown in FIG. 2 the crumb catcher is of trough-like configuration having a generally vertical front wall 22 and a rear wall 24 which curves out and up and then back in a generally semi-cylindrical configuration to terminate in an upper edge 26 which is above and approximately in the same plane as the upper edge 28 of the front wall, forming a slot 30 through which eraser crumbs may be readily received and a deflecting surface 31 which directs the crumbs downward into the trough.

Secured to the edge 18 of the drafting table 10, as by means of screws 32 is a mounting bracket 34 which extends along a substantial portion of the table edge 18. Complementary, inter-engaging members 36 and 38 on the trough 20 and mounting bracket 34, respectively, engage to suspend the trough 24 from the edge 18 of the table with the upper edge 28 in substantially the plane of the table top 11. Preferably a horizontal ledge 40 extending from the upper edge 28 of the front wall forms a continuation of the table top 11. Finally, end caps may be secured to close the end of the trough as by means of a self-threading metal screw 44 engaging in a hole 46 provided therefor on the trough, preferably at the center of curvature of the cylindrical surface 24.

In operation, the trough is suspended from the edge 28 of the table with the surface 40 forming a continuation of the table top 11 and with the back wall and shield 24 extending above the level of the table top. Hence, as eraser crumbs gather on the table top 11 they may be swept casually off the front edge of the table and, with the extended length of the trough 20, no particular aim is required. From time to time as the eraser crumbs accumulate, the trough 20 may simply be lifted from the mounting bracket 34, and with an end cap 42 swiveled on the screw 44 out of closed position, the contents are dumped into the waste backet.

Figure 4:
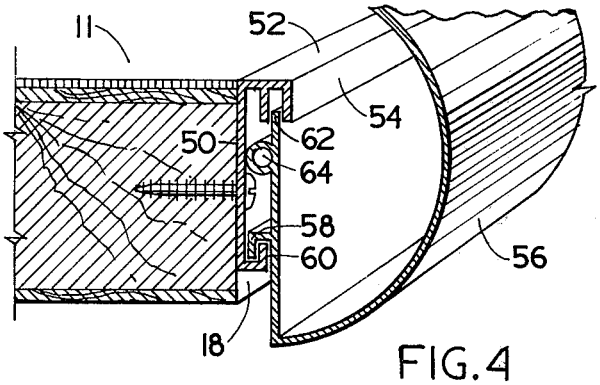
FIG. 4 is a view in perspective taken through a section of the drafting table and another embodiment of this invention.

The Embodiment of FIG. 4

As an alternative embodiment, the mounting bracket 50 may be provided with a forwardly extending ledge 52 and a depending retainer member 54. The trough 56 and mounting brackets 50 have engaging members 58 and 60 respectively and the retaining member 54 covers and retains the upper edge 62 of the top front wall. A slot 64 is provided to receive the end cap screw 44, as in FIG. 3. Hence, in this embodiment, the mounting bracket 50 has an horizontal wall 52 to form a continuation of the surface 11 and the depending member 54 ensures that all crumbs drop within the trough.

While this invention has been described in conjunction with preferred embodiments thereof, it is obvious that other modifications and changes therein may be made by those skilled in the art without departing from the spirit and scope of this invention, as defined by the claims appended hereto.

What is claimed as invention is:

1. An eraser crumb catcher comprising an elongated trough;

a bracket to be secured to an edge of a drafting table;

interengagable means on said trough and bracket for removably supporting said trough on said bracket with a surface on one of said trough and bracket forming a continuation of the upper surface of said drafting table;

the inboard side of said trough when in place depending from said drafting table upper surface; and the outboard side of said trough extending above said upper surface; and an end cap removably secured to one end of said trough.

2. The eraser crumb catcher defined by claim 1 wherein:

said outboard side curves upwardly and rearwardly to terminate above the upper edge of said inboard side.

3. The eraser crumb catcher defined by claim 1 wherein:

the inboard side of said trough comprises a horizontal ledge forming a continuation of the upper surface of said drafting table and a wall depending therefrom.

4. The eraser crumb catcher defined by claim 1 wherein:

said bracket extends along a substantial length of said drafting table edge and includes:

a horizontal ledge forming a continuation of the upper surface of said drafting table.

5. The eraser crumb catcher defined by claim 1 wherein:

said trough is of generally semi-cylindrical cross-section with a generally planar frontwall and an arcuate back wall; and said end cap is of complementary configuration and being secured to said trough by a pin on the center of curvature of said back wall to enable said end cap to swivel to an open position.

* * * * *